United States Patent [19]

Imaseki

[11] Patent Number: 4,792,105

[45] Date of Patent: Dec. 20, 1988

[54] FILM ROLL MOUNTING ASSEMBLY

[75] Inventor: Chiharu Imaseki, Yokohama, Japan

[73] Assignee: Minolta Camera Kabushiki Kaisha, Osaka, Japan

[21] Appl. No.: 59,928

[22] Filed: Jun. 9, 1987

[30] Foreign Application Priority Data

Jun. 18, 1986 [JP] Japan ..... 61-93036[U]

[51] Int. Cl.[4] ..... B65H 16/06

[52] U.S. Cl. ..... 242/68.4

[58] Field of Search ..... 242/68.4, 68.5, 68.6, 242/71.8, 71.9

[56] References Cited

U.S. PATENT DOCUMENTS 3,029,035 4/1962 Layton ..... 242/68.4 X 3,260,362 7/1966 Schwinne ..... 242/68.6 X 3,730,452 5/1973 Schwartz ..... 242/68.5 X 3,997,125 12/1976 Sato ..... 242/68.5

4,277,034 7/1981 Buzzell ..... 242/68.4 X

*Primary Examiner*—Stuart S. Levy

*Assistant Examiner*—Katherine Matecki

*Attorney, Agent, or Firm*—Burns, Doane, Swecker & Mathis

[57] ABSTRACT

A film roll mounting assembly for use in color printers or like machines comprises an attachment spool member detachably mounted on one end of a core sleeve on which a film roll is wound. The attachment spool member includes a flange and concentric recess for receiving the end of the core sleeve to compensate for dimensional inaccuracies in the length of the core sleeve and assure that the film roll is precisely positioned in the machine.

9 Claims, 4 Drawing Sheets

FILM ROLL MOUNTING ASSEMBLY

BACKGROUND OF THE INVENTION

1. Field of the Invention

This invention relates broadly to film roll mounting assemblies used in color printers or the like machines, and especially an attachment spool member thereof to be detachably attached to one end of the core sleeve mounting thereon a roll film mass.

2. Prior Art

These core sleeves are mostly manufactured from paper material, especially on account of cost- and weight reduction possibilities. It has been frequently experienced that these conventional core sleeves lack dimensional preciseness which for example causes various troubles in sensing color zone positions on a tricolor film.

An embodiment of related prior art will be illustrated with reference to FIG. 1 of the accompanying drawings, in advance of detailed disclosure of an inventive embodiment, for better understanding of the invention.

In FIG. 1, a standard model of a conventional film reel or more specifically film roll cartridge proper FC is shown in a perspective view.

In FIG. 1, numeral 1 represents a core sleeve, on which a cylindrical film roll 2 consisting of a long film sheet F, only a part of the latter being shown as has been taken out from the roll, for more convenient illustration purpose only.

In service position, the cartridge proper FC is mounted within the housing of a color printer for cooperation with a conventional thermal head.

In service, the film strip or sheet F is drawn out from the film roll successively and the ink on the sheet F is transferred onto a transfer paper, not shown, each time when the thermal head is operated for execution of printing operation, as is conventionally known.

In a color printing operation with use of a transfer type thermal printer set forth above, such a film roll is utilized by having several different color coatings such as cyanic, yellow, magenta successively applied on the film surface. For each of these color coatings, a separately identifying marking, as at M in FIG. 1, is provided on the end edge zone Fe, which is sensed by a sensor mounted within the color-printing machine, for printing cooperation. In the printing service, therefore, any selected color coating zone may be brought into registration with the transfer service section of the machine, relying upon the corresponding color identifying marking M, and in a successive operation order.

For this purpose, the film roll must be selectively and precisely positioned relative to the transfer service section of the machine. If the film roll was incorrectly mounted the sensor would not be able to detect the selected marking at M.

According to a certain related prior proposal, spools are attached onto both ends of the core tube 1 by taking the end extremities 1*a*; 1*b* thereof as the respective reference planes, for precise holding of the film roll 2 relative to the machine housing.

SUMMARY OF THE INVENTION

It is therefore an object of the present invention to provide an improved film roll mounting assembly capable of operating in an optimal manner regardless of lengthwise dimensional inaccuracy of core sleeves each mounting a film mass, preferably having a series of different color ink layers. These dimensional inaccuracies are caused by lack of manufacturing preciseness; invasion of humidity, outside thermal influence or other causes.

For fulfilment of this and further objects, features and advantages, it is proposed according to this invention to provide such an improved film roll mounting assembly, as comprising:

- a hollow cylindrical core sleeve having at least one open end;
- a roll film mass mounted on said core sleeve; and
- an additional attachment spool member detachably attached to said open end of said core sleeve, said spool member, comprising:
  - a first flange formed on said spool member for slidably contacting the side surface of said roll film mass in operating position;
  - means for positioning said spool member inside said machine: and
  - a concentric axial recess formed on said first flange for slidingly receiving said open end of said core sleeve leaving a variable idle gap space for compensation of manufacturing axial size fluctuation of said core sleeve.

PREFERRED EMBODIMENTS OF THE INVENTION

Referring now to further drawings, several preferred embodiments of the invention will be described more in detail.

Figure 2:
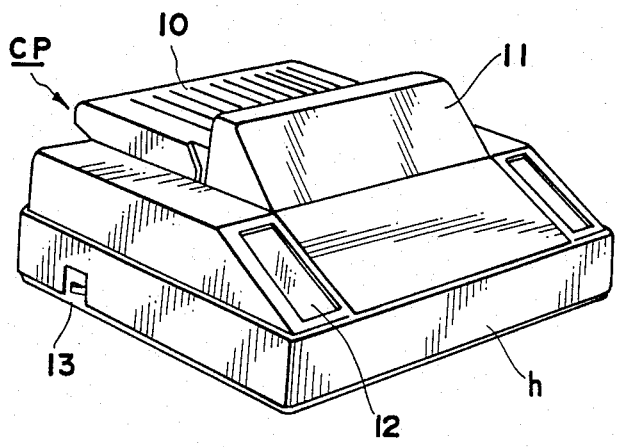
FIG. 2 is a schematic perspective view of a color printer to which the invention is applicable.

In FIG. 2, a color printer in which the inventive film roll spool is to be mounted, is only schematically shown generally at CP in a perspective sketch.

Numeral 10 represents a paper tray for receiving, from the inside of the machine, printed transfer papers, as is conventionally done. 11 represents an openable front panel for providing access to inside parts and units. 12 represents an operation control panel mounting a number of control elements, although not shown, including a print switch provided for initiation of the printing operation. Further, numeral 13 represents a power on/off control switch. Symbol h represents an overall housing of the machine CP.

Figure 3:
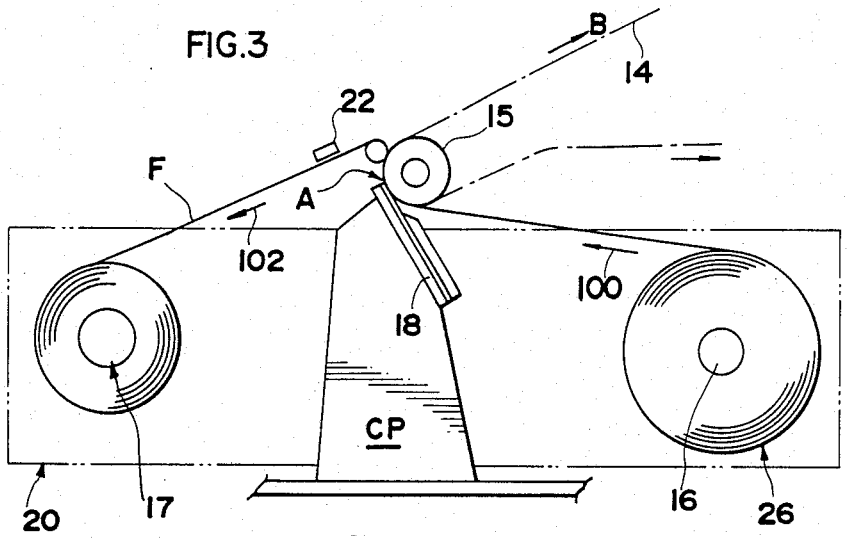
FIG. 3 is an enlarged schematic sectional view of essential parts of the color printer shown in FIG. 2.
Figure 4:
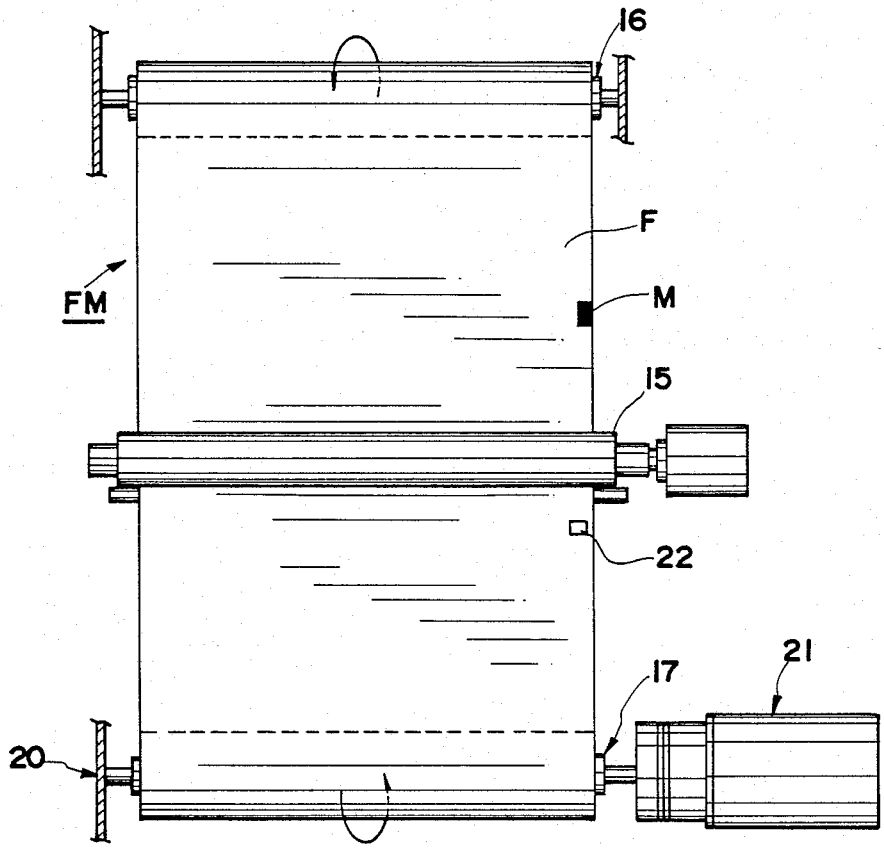
FIG. 4 is an enlarged top plan view of essential parts shown in FIG. 3.

FIG. 3 is a schematic elevational section of the thermal color printer CP, while FIG. 4 is an enlarged top plan view of an ink film feeding mechanism employed therein.

Numeral 15 represents a conventional platen roller consisting of a member in the feeding mechanism FM mounted in the transfer section A of the machine CP, the transfer paper sheet denoted with numeral 14 being guided around the platen roller under slight tension. With regular or reverse rotation, as the case may be, of the platen roller, paper sheet 14 being is fed forward in the direction shown by a small arrow B, or in the reverse direction.

Numeral 16 denotes an ink film supply roll on which a film roll 26 is mounted so as to form a film supply source, while 17 represents a film wind-up roll. The film sheet F is taken out from the roll 26 and carried forward as shown by a small arrow 100 onto platen roll 15 through the intermediary of transfer paper sheet 14 in a tightly overlapped manner and then passed around a small pressurizing and guiding roller 101, further turning its travel passage therefrom toward wind-up roll 17, as shown by a further arrow 102, for being finally wound up therearound into a new roll 103.

Numeral 18 represents a conventional thermal head. With printing operation of the latter, the ink is transferred from the film F onto the travelling transfer paper sheet 14 which is thus subjected to a printing job, and so on.

Supply roll 16 and wind-up roll 17 are normally contained in a cassette 20, which is shown only by its outline configuration in FIG. 3. This cassette 20, together with the contained rolls 16;17, can be taken out as a whole from the machine CP upon opening of the cover 11. Reversely, the cassette 20 can be recharged from outside into the machine through a now exposed opening, not shown, formed, upon opening of the cover through the related wall portion of machine housing h.

With recharging of the cassette 20 into the machine housing in a ready-to-operate position, an electric drive motor 21 is mechanically connected with wind-up roll 17 through a conventional mechanical coupling or clutch, not shown, for establishing a drivable connection, although not shown, thereby the printed portion of film sheet F being progressively wound up on the roll 17, as the printing job proceeds and under proper control of the drive motor 21, as is highly well known in the art.

Figure 5:
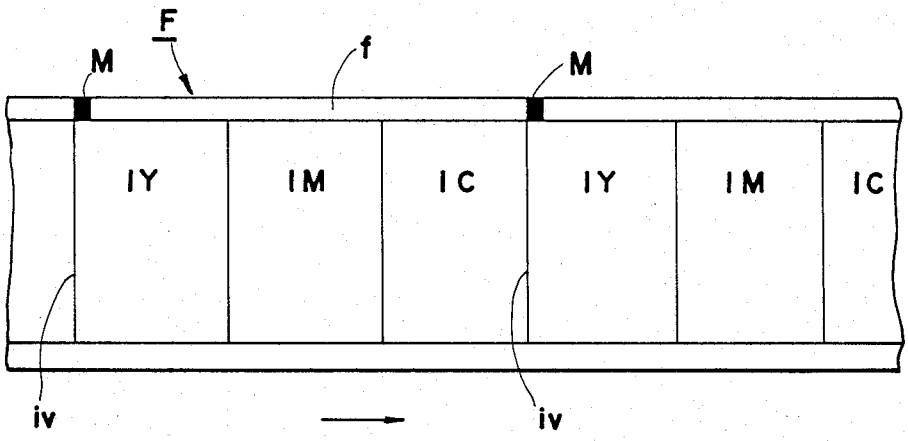
FIG. 5 is a top plan view of a part of tricolor ink film, shown in a somewhat reduced scale.

The elongated film F, having substantially the same width as the transfer paper 14, is shown in FIG. 5 and at a substantially reduced scale from that adopted in FIG. 4. This film is of three-color mode. IY represents yellow ink-coated zones; IM magenta ink zones and IC cyanic ink zones, wherein these zones are arranged in a periodically spaced series. Further, an identifying marking M is provided on a small width, elongated and continuous marginal zone f and in registration with the leading edge iv of each yellow ink-coated divided area IV. Each of these markings M is sensed by a stationary sensor 22 shown in FIGS. 3 and 4 only schematically. This sensor 22 is positioned naturally in practice, in close proximity of platen roller 15. Control of the film feed is made by reliance of the aforementioned sensor's operation, so as to bring any desired color ink zone into registration with the position of transfer service section A of the machine.

Figure 6:
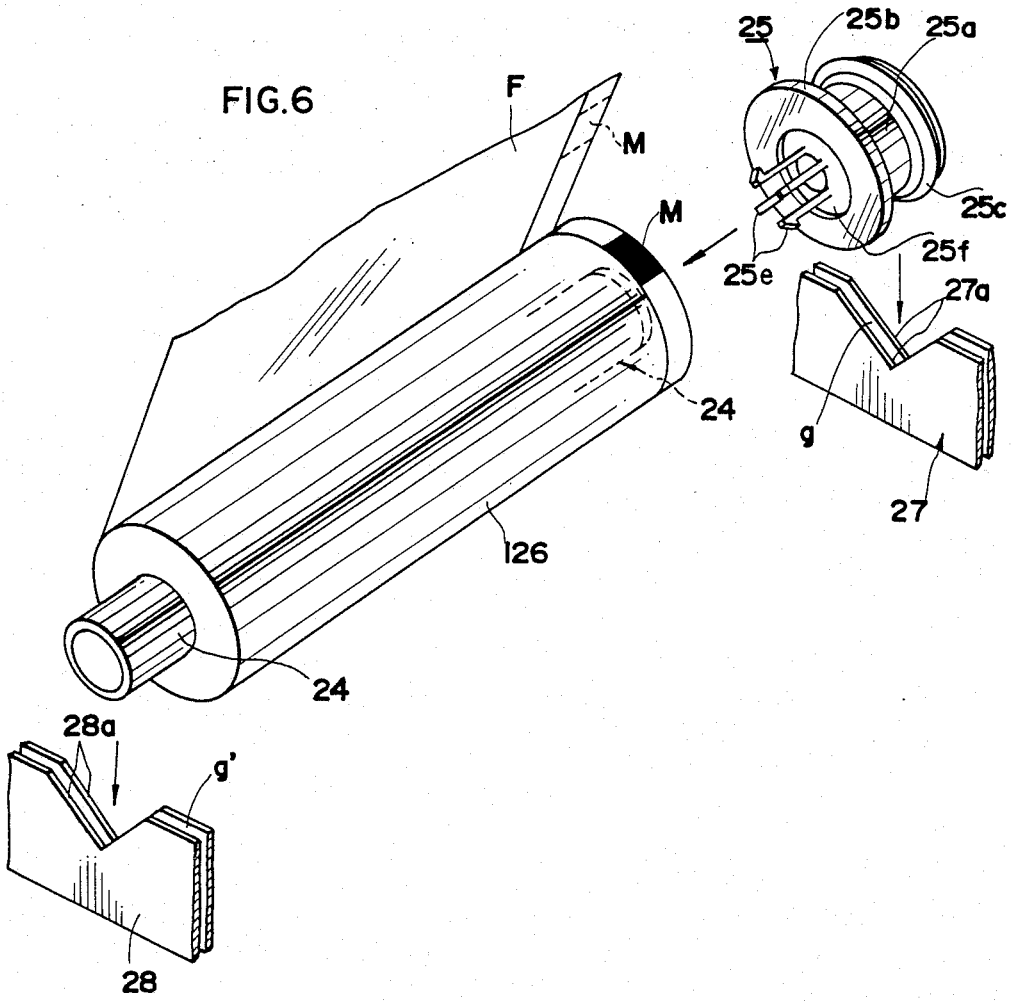
FIG. 6 is an exploded perspective view of several main components of the inventive film roll mounting assembly shown in a somewhat reduced scale.
Figure 7:
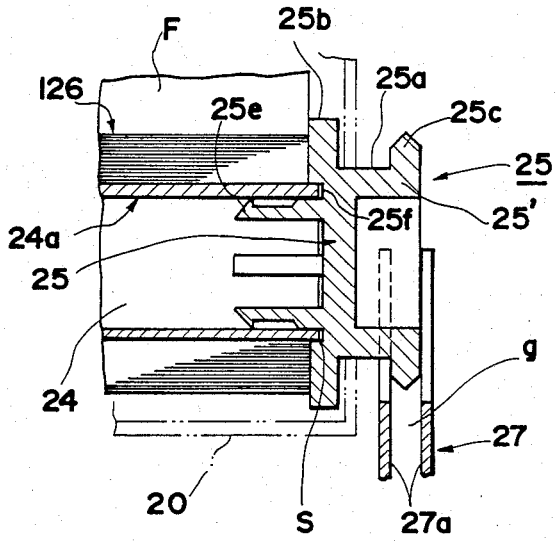
FIG. 7 is an axial section of an attachment spool member constituting a main improved component of the inventive assembly.

In FIGS. 6 and 7, the film-positioning mechanism is shown.

Figure 1:
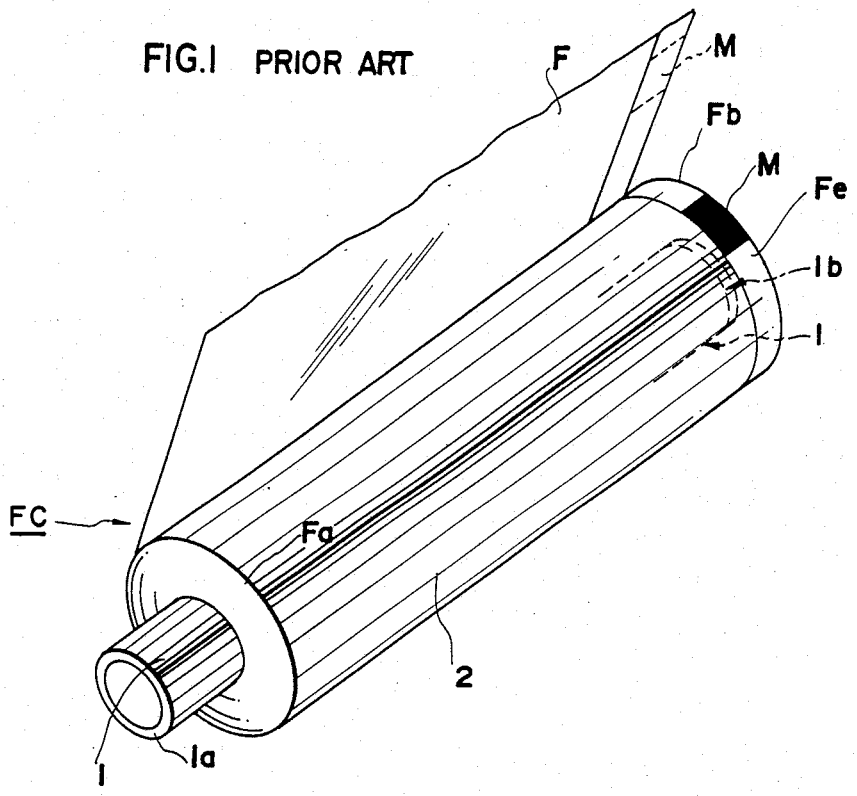
FIG.1 PRIOR ART
FIG. 1 is a perspective view of a preferred embodiment of a comparative conventional core sleeve mounting a film roll mass, and constituting the starting point of the inventive improvement.

In these drawings, numeral 24 represents a core sleeve which is similar to that shown by 1 in FIG. 1. A film roll 126 similar to that shown at 26 in FIG. 1 is mounted on the sleeve as before. At one end thereof, a spool 25, preferably resin-made, is detachably coupled. This spool 25 serves for identification of radial direction of the film mass 126, as will be described more fully hereinafter.

In practice, the combination of core sleeve 24 and spool 25 constitutes the foregoing film-supply roll 16.

Main and central portion 25' of spool 25 is formed on its outer cylindrical surface with a ring recess **25*a* and at one end thereof integrally with a concentric flange 25*b* adapted for establishing a tight, but slidable contact with outer surface of the film roll 126, as is clearly seen from FIG. 7. Spool 25 is further formed integrally at its opposite axial end with another flange 25*c* which has an edge-pointed outer configuration in its axial section, as more clearly shown in FIG. 7, for serving to execute the desired axial positioning, as will be more fully described hereinafter. A plurality of axially extending, elastic finger-like projections 25*e* arranged on a concentric circle are provided integrally with the first and inside flange 25*b*. Tip end of each projection 25*e* is formed into a reversing hook, as clearly seen from FIGS. 6 and 7**.

For attaching the spool 25 into position, the operator grips the latter by his hand and pushes it from outside into the hollow space portion at the right hand end of the spool 24, so as to engage the finger projections **25*e* with the inside wall surface 24*a* thereof. The thus-established pressure contact of hooked tip ends of finger projections 25*e* will provide a heavy frictional force against occasional disengagement of the spool 25** from position in the axial outward direction.

A concentric circular recess **25*f* is formed along and outside a common circle imaginarily drawn at the root portions of all the finger projections 25*e* is formed in the outer surface of flange 25*b*, for receiving the related outer end of core sleeve 24 when the spool 25 is attached thereto into position, as shown in FIG. 7. This recess 25*f*** is provided for providing an axial variable idle space, as shown at S, for compensating axial and minor size fluctuations of related parts, as will be described more fully hereinbelow.

More specifically, the depth or longitudinal length of the circular recess **25*f* is selected to be larger than the maximum possible projecting length from the related side surface of the film mass 126**.

When, therefore, the extreme end of a core sleeve 24 having a maximum possible axial length, when considering the manufacturing size fluctuation, extends in practical use as shown in FIG. 7 from the related side surface of film roll mass 126, the projecting portion of core sleeve 24 can be well received in the axial recess **25*f* of spool 25, thereby leaving an axial idle space or gap S between the sleeve and the spool, while the flange 25*b* of the latter is kept in tight and slidable contact with the side surface of film mass 126. Thus, in the operating position of the assembly, the relative axial distance between the outwardly edged flange 25*c* of spool 25 and the side surface of the film mass is kept always at a constant value. In this way, the edged flange 25*c* serves as an axial positioning means for the desired purpose with no regard of practical extruding degree relative to the side surface of film mass 126** and to a highly precise dimensional degree.

Within the interior space of the machine CP, a pair of mounting vee-blocks 27; 28 are arranged at a properly selected mutual distance, although not specifically shown on account of highly known nature, for detachably mounting the opposite or left hand end of core sleeve 24, FIG. 6, and the circular recess or groove 25*a* on spool 25, when the latter has been attached to the core sleeve wound with the film mass and then the resulted assembly is introduced into the cassette 20. Upon charging the latter into the machine CP in position, the assembly is rotatably mounted on the vee-recesses 27*a;* 28*a* of the mounting blocks 27; 28, respectively, while keeping the film mass always in the required correct position, as was already referred to in the foregoing. Additionally, the vee-blocks 27; 28 are constructed in a double wall structure, providing respective idle axial gaps g; g', respectively, as shown clearly in FIG. 6. When the film roll-mounting assembly is charged into the machine, the sharp edged flange 25*c* of the attachment reel 25 is introduced in the idle gap g so that correct axial positioning of the film mass can always be established and maintained. Thus, this flange 25*c* serves as a positively positioning reference means.

As a result, the additional positioning spool member 25 controls positively and positioningly the position of the side surface of the film roll mass 126 to be kept in contact with the first flange 25*b* of the spool member 25 within limits of the fabrication preciseness thereof, thereby the corresponding side edge of ink film strip F taken out from the mass 126 may be controlled in its running position in the similar way.

In this way, the travelling course of the ink film strip F taken out from the film supply roll 16 may be kept constant regardless of occasionally appearing unprecise or rough end-cutting of core sleeve 24 and/or size variation in the length of the latter as caused by changes in environmental temperature or humidity conditions. Thus, the color identification markings M can be brought into registration with sensor 22 in a highly precise manner and the marking read-out operation can be performed in a very positive and accurate manner as desired.

Figure 8:
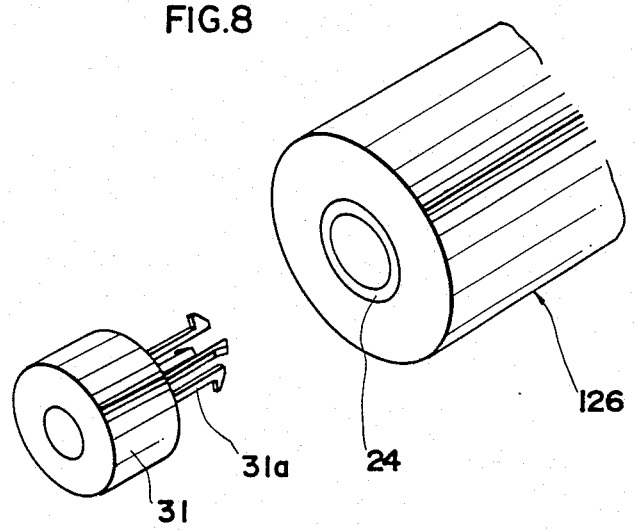
FIG. 8 is an exploded perspective view showing a modification of the invention.

In a modified embodiment shown in FIG. 8, a resin-made, attachment member 31 is provided which is arranged at the other end of core sleeve 2 than that with which the attachment spool 25 has been cooperated. This member 31 is also formed with a plurality of axially extending resilient finger-like projections 31*a* for frictionally engaging with the currently considering end of core sleeve 24. Although not specifically shown, this attachment member 31 is formed with a similar positioning recess as that which has been illustrated with reference numeral 25*a*. With use of the pair of vee-blocks 27; 28, precise centering of the attachment spool 25 may be executed in a highly simple and easy manner.

Although an illustrated embodiment with certain modifications of the present invention has been described in detail hereinabove with reference to the accompanying drawings, it is to be understood that the invention is not limited to that embodiment, and that various modifications and variations may be effected therein by one skilled in the art without departing from the scope and spirit of the invention as defined in the appended claims.

As an example, an opposing pair of bar members, each having end screw portion, are provided and partially introduced into the both open ends of the core sleeve and female-threaded and attachment members are attached threadingly to the screw ends of said bars, so as to hold the core sleeve in a squeezed manner therebetween. In this modification, one of these end attachment members may be used as the axially positioning member in the similar way as the foregoing positioning flange 25*c*. The positioning member as used in this modification may be made in unison with related bar member.

If necessary, the core sleeve is made of resin material and then, the positioning member may be connected with the core sleeve by utilization of screw thread means.

What is claimed is:

1. A film roll mounting assembly for a printer comprising:

a hollow cylindrical core sleeve having an inside, an inner space and at least one open end;

a roll film wound on said core sleeve with said open end projecting out from a side end of said roll film;

a spool member attached to said open end of said core sleeve and including a positioning member in contact with said side end of said roll film, and a recess formed on said positioning member to receive said open end of said core sleeve, said recess having a base and the depth of said recess being greater than the length of said projecting open end of said core sleeve so as to leave a gap between said core sleeve and the base of said recess, and a holding member for holding said core sleeve concentric with said spool member; and means for positioning said spool member, said spool member being rotatable together with core sleeve to supply the film.

2. The film roll mounting assembly as claimed in claim 1 wherein said holding member comprises a plurality of elastic finger projections formed on said positioning member and extending into the inner space of said core sleeve for acting as mechanical coupling means with said open end of said core sleeve, each of said finger projections having a hook in contact with the inside of said core sleeve to exert a heavier frictional resistance in detecting said spool member from said core sleeve.

3. The film roll mounting assembly as claimed in claim 2, wherein said finger projections are arranged on an imaginary circle drawn on a sectional plane relative to said spool member.

4. The film roll mounting assembly as claimed in claim 1 wherein said roll film comprises marks arranged at an end of the widthwise direction of said roll film.

5. The film roll mounting assembly as claimed in claim 1 wherein said positioning means positions said spool member in the axial direction of its rotation and holds said spool member rotatably.

6. The film roll mounting assembly as claimed in claim 1 wherein said spool member further comprises a flange formed along a periphery of said spool member.

7. The film roll mounting assembly as claimed in claim 6 wherein said positioning means comprises a positioning wall having a groove for rotatably supporting said spool member, and a positioning gap formed in a direction perpendicular to an axis of rotation of said spool member on said groove to receive said flange.

8. The film roll mounting assembly as claimed in claim 1 further comprising a second spool member attached to a second open end of said core sleeve.

9. The film roll mounting assembly as claimed in claim 8 wherein said second spool member comprises a holding member for holding said core sleeve concentric with said second spool member.

* * * * *